United States Patent [19]

Patel

[11] Patent Number: 4,829,410

[45] Date of Patent: May 9, 1989

[54] CEILING MOUNTED LUMINAIRE HOUSING SYSTEM

[75] Inventor: Mahendra K. Patel, Dix Hills, N.Y.

[73] Assignee: Emerson Electric Co., St. Louis, Mo.

[21] Appl. No.: 63,024

[22] Filed: Jun. 17, 1987

[51] Int. Cl.[4] ..... F21S 1/02

[52] U.S. Cl. ..... 362/147; 362/364; 362/365; 362/368; 362/418; 362/430

[58] Field of Search ..... 362/430, 147, 296, 364, 362/365, 368, 370, 371, 396, 406, 306, 295; 248/342, 343, 295.1

[56] References Cited

U.S. PATENT DOCUMENTS

| | | | |
|---|---|---|---|
| 2,518,936 | 8/1950 | Roberts | 362/364 |
| 3,683,173 | 8/1972 | Guth, Jr. | 362/364 |
| 4,274,615 | 6/1981 | Chan | 362/365 |
| 4,336,575 | 6/1982 | Gilman | 365/365 |
| 4,408,262 | 10/1983 | Kusmer | 362/365 |
| 4,431,151 | 2/1984 | Schonasky | 248/342 |
| 4,459,648 | 7/1984 | Ullman | 362/365 |
| 4,520,436 | 5/1985 | McNair et al. | 362/147 |

FOREIGN PATENT DOCUMENTS

| | | | |
|---|---|---|---|
| 492542 | 5/1953 | Canada | 362/365 |

*Primary Examiner*—James C. Yeung

*Attorney, Agent, or Firm*—Polster, Polster and Lucchesi

[57] ABSTRACT

A housing system for ceiling mounted recessed luminaires includes a generally flat, rectangular mounting plate. A circular, vertically extending flange extends downwardly from the lower surface of the mounting plate. The diameter of the circular flange is substantially the same as the width of the mounting plate. A cylindrical lamp housing is secured to the mounting plate and extends upwardly therefrom. Mounting plate also has a junction box secured thereto with its largest dimesion disposed vertically from the mounting plate. An electronic conduit extends between the junction box and the lamp housing.

5 Claims, 2 Drawing Sheets

FIG. 3.
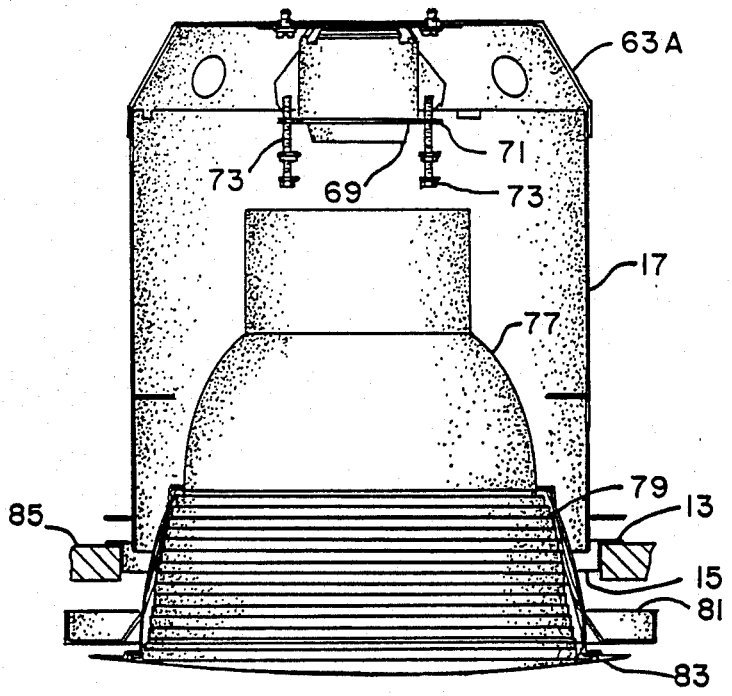
FIG. 4.
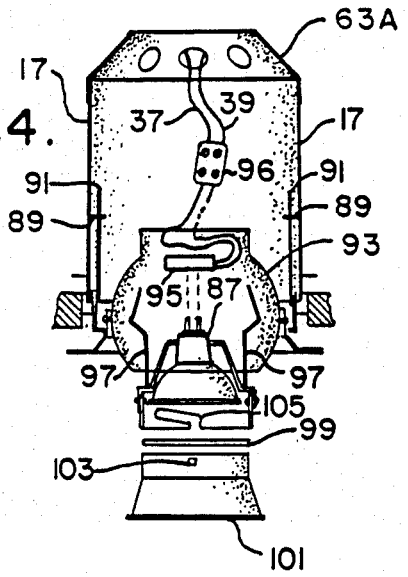
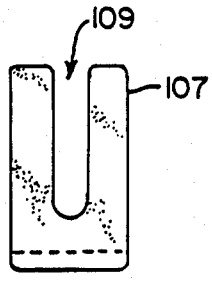
FIG. 5.
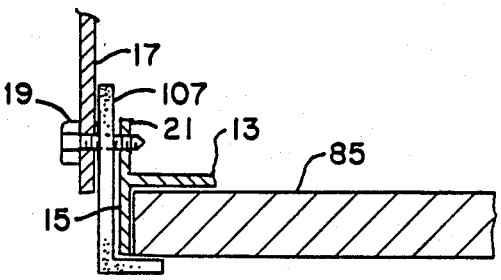
FIG. 6.

CEILING MOUNTED LUMINAIRE HOUSING SYSTEM

BACKGROUND OF THE INVENTION

This invention relates to the field of lighting fixtures and more particularly to a housing system for ceiling mounted lighting fixtures especially adapted for both new and existing ceiling installations.

Prior ceiling mounted lighting fixtures included a frame having arms or the like thereon for securing the frame to the structural supports of a ceiling. In one typical installation, the frame of the lighting fixture may be secured by suitable fasteners to the joists supporting the ceiling. In a hung ceiling installation on the other hand, a metal gridwork is suspended from the overhead structure and the frames of prior lighting fixtures are provided with guideways or other structure for mounting to the grid components for supporting the fixture at any desired location. In both these type of ceiling installation, the installer has access to the joists or the metal grid so that he is readily able to attach the lighting fixture to the structural elements.

Such systems could be improved. For example, with existing systems the shape of the frame heretofore has made it extremely difficult if not impossible to place a lighting fixture directly adjacent one of the supporting members such as a joist. In addition, when used with suspended ceilings, the existing systems have often required that an electrical conduit supplying the power to the lighting fixture have a ninety degree bend therein to clear the supporting members. This unnecessarily increases installation time and cost, particularly where through wiring is required since a pair of ninety degree bends are required in that instance.

Existing lighting fixtures are not all easily adaptable to various thicknesses of ceilings, which again increases installation time and the cost. Moreover, it is occasionally desirable to add lighting fixtures to existing ceilings. Many prior lighting fixtures are not suited for installation in such existing ceilings. Installation in existing ceilings is difficult because of the problem of securing the fixture to the ceiling and the limited amount of space available for wiring and inspection. Moreoever, it would be desirable to have a single ceiling mounted lighting fixture housing system which was useable for both existing ceilings and for new construction.

SUMMARY OF THE INVENTION

Among the various objects and features of the present invention may be noted the provision of a housing system for ceiling mounted luminaires which is useable for both new and existing ceiling installations.

Another object of the present invention is the provision of such a system which provides for easier access through the ceiling opening for wiring and inspection.

A third object of the present invention is the provision of such a system which allows zero clearance installation for flexibility in installing the system in the tightest space possible.

A fourth object of the present invention is the provision of such a system which simplifies the installation of a lighting fixture in existing ceilings.

A fifth object of the present invention is the provision of such a system which allows through-wiring without requiring ninety degree bends in the electrical supply pipe.

A sixth object of the present invention is the provision of such a system which allows for easy adjustment to accommodate different ceiling thicknesses.

Other objects and features will be in part apparent and in part pointed out hereinafter.

A housing system for ceiling mounted recessed luminaires of the present invention includes a generally flat, rectangular mounting plate having a length substantially greater than its width. A generally circular, vertical flange extends downwardly from the lower surface of the mounting plate, the diameter of the circular flange being substantially the same as the width of the mounting plate to provide minimum clearance between the flange and any obstruction. A generally cylindrical lamp housing is secured to the mounting plate and extends upwardly therefrom, which housing is generally centered with respect to the vertical flange. A junction box is secured to the mounting plate, and a conduit electrically connects the junction box and the lamp housing to complete an electrical circuit therebetween.

DESCRIPTION OF THE DRAWINGS

FIG. 3 is a schematic view illustrating the installation of a luminaire in the housing system of the present invention;

FIG. 4 is a view similar to FIG. 3 illustrating the attachment of a second type of luminaire to the housing system of the present invention;

FIG. 5 is a front elevation on an enlarged scale of a ceiling clip used in securing the housing system of the present invention to an existing ceiling; and FIG. 6 is a sectional view illustrating the use of the clip of FIG. 5.

Similar reference characters indicate similar parts throughout the several views of the drawings.

DESCRIPTION OF THE PREFERRED EMBODIMENT

Ceiling mounted luminaire housing system 11 (FIGS. 1 and 2) includes a generally flat, rectangular shaped mounting plate 13 having a length substantially greater than its width. As seen best in FIG. 2, a generally circular, vertical flange 15 extends downwardly from plate 13. The diameter of circular flange 15 is substantially the same as the width of mounting plate 13 to provide minimum clearance between the flange and any obstruction. This feature allows the housing system 11 to be placed adjacent an obstruction such as a joist and the lighting fixture to be secured thereto from below without the need for any clearance between the depending flange and the obstruction.

Figure 2:
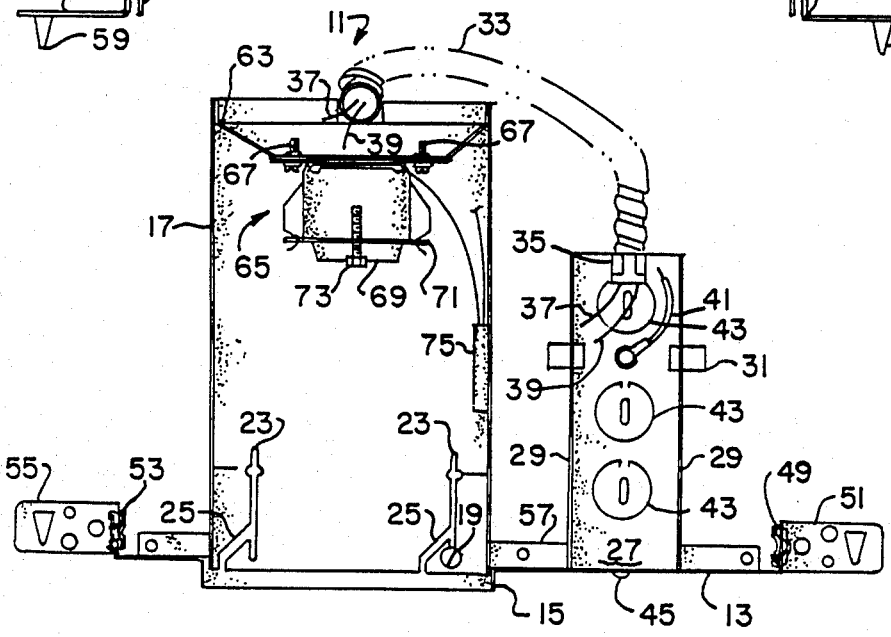
FIG. 2 is a cross-sectional view taken generally along lines 2—2 of FIG. 1.

A generally cylindrical lamp housing 17, centered with respect to vertically depending flange 15, extends upwardly from mounting plate 13 and is secured thereto by a plurality of threaded fasteners 19. More particularly, mounting plate 13 has a plurality of semi-circular tabs 21 punched out of its surface and disposed at right angles to that surface to provide mounting points for housing 17. Threaded fasteners 19 (see FIG. 2) pass through inverted Y-shaped slots 23 in housing 17 and through tabs 21 to secure the housing to the mounting plate. As can be seen in FIG. 2, Y-shaped slots 23 have a generally vertically extending run which allows the housing to be mounted at a plurality of vertical locations with respect to the mounting pate 13 to allow the housing system to be used with ceilings of various widths. Each Y-shaped slot 23 also includes an inclined slot section 25 which is open at the bottom of housing 17. This allows the housing to be completely removed from mounting plate 13 without requiring the removal of threaded fasteners 19. This of course facilitates the installation and/or repair of any lighting fixture and the housing system itself.

Housing system 11 also includes a junction box 27 having removable front and back covers 29 secured to the junction box by a mounting spring 31. A flexible metal conduit 33 along with conventional fasteners 35 are provided for making electrical connection (as indicated by wires 37 and 39) between housing 17 and junction box 27. A ground wire 41 is preconnected to the wall of junction box 27 to allow the junction box to be properly grounded.

Junction box 27 includes a plurality of knock-outs 43 which are disposed in the walls of junction box 27 on each side and on the top of the junction box. These knock-outs are provided to allow quick and easy through-wiring of electrical cable. The junction box 27 itself is disposed with its long dimension upright so that the topmost knock-out 43 in each side is disposed with its center at about four inches above the plane of mounting plate 13. This height normally allows electrical conduit to pass into junction box 27 without a ninety degree bend being made in the conduit. This feature facilitates the installation and wiring of the present system.

Figure 1:
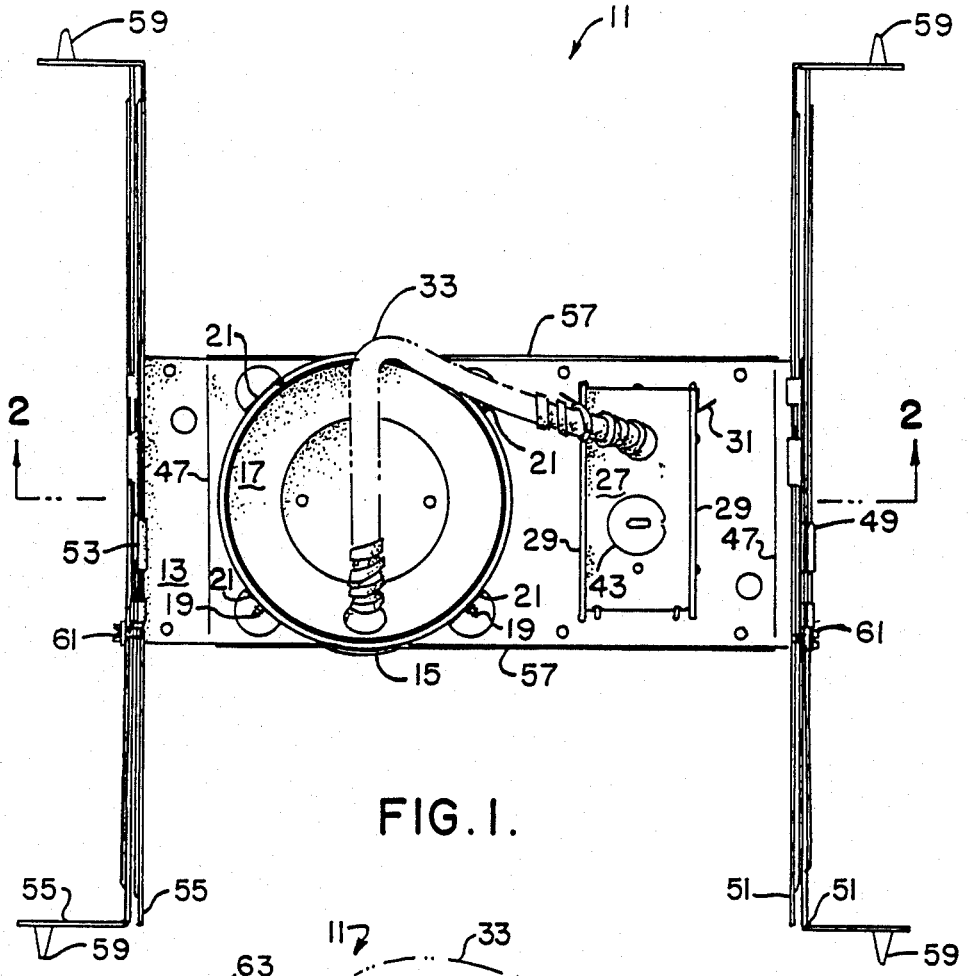
FIG. 1 is a top plan of the housing system of the present invention.

Junction box 27 is suitably secured to mounting plate 13 by a pair of rivets 45 or the like. As best shown in FIG. 1, junction box 27 is disposed with its transverse axis parallel to the ends of mounting plate 13.

Mounting plate 13 includes a pair of scorelines 47 generally parallel to the ends of the mounting plate. The rightmost scoreline 47 as shown in FIG. 1 is disposed between junction box 27 and a raceway 49. Raceway 49 extends upwardly from mounting plate 13 and slidingly and adjustably retains a pair of mounting bars 51.

A similar raceway 53 adjustably and slidingly retains a pair of mounting bars 55 at the other end of mounting plate 13. A second scoreline 47 is also disposed between this second raceway 53 and housing 17.

As shown in FIG. 1, the mounting bars are parallel to the transverse axis of junction box 27 and to scorelines 47. These scorelines are provided so that raceways 49 and 53 along with their accompanying mounting bars may be permanently removed when system 11 is to be used in an existing ceiling. In that instance, mounting plate 13 is severed at scorelines 47 to remove the raceways and the mounting bars permanently.

Mounting plate 13 also includes a pair of ribs 57 which extend along each side of mounting plate 13 but which stop short of the scorelines. These ribs 57 extend upwardly from the relatively flat surface of mounting plate 13.

Mounting bars 51 and 55 and raceways 49 and 53 are provided to allow easy adjustment of the width of system 11 so that it may be mounted between joist of various spacings. Alternatively, with T-bar clips (not shown) the mounting bars may be secured to suspended ceiling grids. Each mounting bar includes a conventional nail-in tab 59. Each raceway is provided with a lockscrew 61 which assures consistent fixed and off-center alignment of the system. As can be seen in FIG. 2, the lower portions of raceway 49 and 53 and mounting bars 51 and 55 are generally flush with the bottom surface of mounting plate 13.

Housing 17 includes a lid 63 disposed at the top thereof through which the electrical conduit from junction box 27 extends. A socket assembly 65 is suitably secured by threaded fasteners 67 to lid 63 to preset the socket position in housing 17. Socket assembly 65 includes a socket 69, an adaptor plate 71 and a plurality of threaded fasteners 73 disposed in the adaptor plate 71. Adaptor plate 71 and threaded fasteners 73 are used as one alternative way of mounting the lighting fixture to housing 17. Housing 17 also has a thermal protector 75 secured to the inner wall thereof which functions in the conventional manner.

In new ceilings, mounting bars 51 and 55 are hammered into desired joists. The lower portion of the mounting bars as shown in FIG. 2 are aligned flush with the lower edge of the joist to quickly align the housing system with the joist bottom. Of course, T-bar clips are used instead to mount the mounting bars to the suspended ceiling members in a suspended ceiling installation. Screws 61 are then used to lock mounting plate 13 in position. The supply leads are then fed into and/or through junction box 27 to make electrical connection between the supply Ieads and socket 69. The ceiling itself is then installed under rough-in housing 11 and a hole in the ceiling itself is made to fit around flange 15. At that point, one of any number of lamps and trims may be installed in housing 17. Two such alternative lamps and trims are shown in FIGS. 3 and 4.

For example, in FIG. 3 a reflector 77 is secured by threaded fasteners 73 to adaptor plate 71. Note that in FIGS. 3 and 4, housing 17 has an upwardly extending lid 63A instead of the downwardly extending lid 63 shown in FIG. 2. After reflector 77 with its attached baffle 79 is secured to adaptor plate 71, a desired lamp is installed in socket 69 and the installation is complete. Note that in FIG. 3 the reflector 77 carries its own trim 81 and trim ring 83. Of course, with other lighting fixtures, these elements could be separate. In FIG. 3, mounting plate 13 rests upon the ceiling 85 and housing 17 is disposed with its lowermost portion above the bottom of flange 15. If the ceiling were thicker, housing 17 could be disposed relatively lower by means of slot 23 as discussed above to compensate for this difference in thickness.

If FIG. 4, a different lamp 87 is shown mounted in a housing 17 of the present invention by means of a pair of housing tabs 89 formed in the wall of the housing. These tabs secure a pair of torsion springs 91, which are in turn secured to an eyeball-type mount 93. Electrical connection in this case is made by a socket 95 which snaps into the back of lamp 87 and is connected by suitable wires to a terminal block 96 connected to wires 37 and 39. Socket 69 and adaptor ring 71 are not shown in this FIG. Note that adaptor ring 71 is not used in this case to attach the lighting fixture to the housing. Rather torsion springs 89 and housing tabs 91 perform this function. Of course, other mounting structure such as suitably shaped slots and the like could also be provided in housing 17 to allow a number of different lighting fixtures having various mounting means to be used with the same universal housing.

Lamp 87 is secured to eyeball mount 93 by means of a pair of springs 97 which allow the lamp to be removably snapped into place in eyeball mount 93. This allows ready access to the lamp. A lens 99 is disposed below lamp 87. This lens is secured adjacent the lamp by a support ring 101 which mounts to the lamp by means of a pair of bayonet tabs 103. Tabs 103 are moveable in corresponding lamp slots 105 to secure the support ring and the lens to the lamp.

In FIGS. 3 and 4 the housing has been placed in a new ceiling, but the present invention is not so limited. A plurality of generally L-shaped clips 107 (FIG. 5) with a slot 109 disposed in the leg thereof are provided to allow installation of housing system 11 in existing ceilings. For this to occur, scorelines 47 as shown in FIG. 1 are manipulated so that raceways 49 and 53 with the accompanying mounting bars are snapped off mounting plate 13. This reduces the width of housing system 11 to a width generally the same as the diameter of the hole which is cut in the existing ceiling to accommodate the lighting fixture. The mounting plate with its junction box is then fed through the hole and laid on the top of the existing ceiling. Depending flange 15 centers the housing in the hole cut in the existing ceiling. At this point, electrical conduit 33 is allowed to fall down through the hole in the ceiling and housing 17 is disposed below the level of the ceiling. This allows easy access to junction box 27 for making desired electrical connections. Housing 17 is then moved up into the position shown in FIG. 2. The housing is then held in place by a pair of ceiling clips 107 which are positioned as shown between housing 17 and upstanding tabs 21. Slot 109 is provided in the ceiling clips so that the relative height of housing 17 with respect to a tab 21 may be adjusted. The foot of ceiling clip 107 is disposed under ceiling 85 so that once fastener 19 is tightened, the housing 17 and mounting plate 13 are fixed in position with respect to ceiling 85.

In view of the above it will be seen that the various objects and features of the present invention are achieved and other advantageous results obtained. As various changes could be made in the above constructions and methods without departing from the scope of the invention, it is intended that all matter contained in the above description and shown in the accompanying drawings shall be interpreted as illustrative and not in a limiting sense.

I claim:

1. A housing system for ceiling mounted recessed luminaires comprising:

a generally flat, rectangular mounting plate having a length substantially greater than its width;

a generally circular, vertical flange extending downwardly from the lower surface of the mounting plate, the diameter of the circular flanges being substantially the same as the width of the mounting plate to provide minimum clearance between the flange and any obstruction;

a generally cylindrical lamp housing secured to the mounting plate and extending upwardly therefrom, said housing being generally centered with respect to the vertical flange;

a junction box having a pair of opposed sides and a pair of opposed ends, the length of the sides being substantially greater than the length of the ends, said junction box being secured to the mounting plate by one end of the junction box so that the sides extend vertically upwardly from the mounting plate;

a pair of opposed upstanding ribs extending along the sides of the mounting plate, said ribs extending generally the length of the plate;

means for electrically connecting the junction box and the lamp housing to complete an electrical circuit therebetween; and upstanding sliding raceways disposed at both ends of the mounting plate to adjustably retain two pairs of mounting bars, said mountings bars being suitable for mounting the housing system to a pair of joists or the like in a ceiling, the mounting plate including a pair of scorelines generally parallel to the ends of the mounting plate and disposed inboard of the two raceways so that the upstanding raceways and the accompanying mounting bars may be permanently removed from the mounting plate if desired by severing the mounting plate at the scorelines.

2. The housing system as set forth in claim 1 wherein the junction box is generally rectangular, the junction box being disposed so that the transverse axis of the junction box is generally parallel to the longitudinal axes of the mounting bars, one end of the junction box being mounted to the mounting plate and the opposite end thereof being disposed over four inches above the mounting plate.

3. The housing system as set forth in claim 2 wherein each side of the junction box includes a plurality of knock-outs, at least one of said knock-outs being disposed at least four inches above the mounting plate.

4. The housing system as set forth in claim 1 further including a plurality of clips removably securable to the housing for securing the housing to the ceiling, each clip being generally L-shaped with a central longitudinal slot therein, said housing system including threaded fasteners for adjustably securing the clips to the housing at a position in which the foot of each L-shaped clip engages the bottom surface of the ceiling, the longitudinal slot extending vertically, from said foot and the leg of each L-shaped clip being secured by a threaded fastener to the housing to hold the housing securely in place with respect to the ceiling.

5. A housing system for ceiling mounted recess luminaires comprising:

a generally flat, rectangular mounting plate having a length substantially greater than its width;

a generally circular, vertical flange extending downwardly from the lower surface of the mounting plate, the diameter of the circular flange being substantially the same as the width of the mounting plate to provide minimum clearance between the flange and any obstruction;

a generally cylindrical lamp housing secured to the mounting plate and extending upwardly therefrom, said housing being generally centered with respect to the vertical flange;

a junction box having a pair of opposed sides and a pair of opposed ends, the length of the sides being substantially greater than the length of the ends, said junction box being secured to the mounting plate by one end of the junction box so that the sides extend vertically upwardly from the mounting plate;

a pair of opposed upstanding ribs extending along the sides of the mounting plate, said ribs extending generally the length of the plate;

means for electrically connecting the junction box and the lamp housing to complete an electrical circuit therebetween;

said mounting plate including a plurality of upstanding tabs, further including a plurality of fasteners for securing the housing to the upstanding tabs, the housing including a plurality of vertically extending slots alignable with said mounting plate tabs so that the relative vertical position of the housing with respect to the mounting plate is adjustable, said vertically extending slots being closed at the bottoms thereof, said housing further including for each vertical slot an inclined slot in communication therewith, said inclined slot extending to the bottom of the housing and being open at the bottom of said housing.

* * * * *